United States Patent [19]

Salerno

[11] Patent Number: 4,481,698

[45] Date of Patent: Nov. 13, 1984

[54] CHUTED MIXER FORMING METHOD

[76] Inventor: Alan F. Salerno, 25 Holten St., Peabody, Mass. 01960

[21] Appl. No.: 384,130

[22] Filed: Jun. 1, 1982

[51] Int. Cl.[3] ..... B21K 3/04; B23P 15/02; B23P 15/04

[52] U.S. Cl. ..... 29/156.8 R; 29/157 R; 29/156.4 R; 29/157 C; 72/168; 72/384; 228/173 C; 228/173 D

[58] Field of Search ..... 29/156.8 R, 156.8 H, 29/156.8 B, 156.8 CF, 157 C, 156.8 PC, 455 R, 157 R, 156.4 R; 72/176, 177, 335, 324, 336, 363, 379, 168, 384; 60/262, 271; 239/265.19; 428/603; 228/173 C, 173 D

[56] References Cited

U.S. PATENT DOCUMENTS

| | | | |
|---|---|---|---|
| 464,403 | 12/1891 | Turpin | 72/168 |
| 968,789 | 8/1910 | Olb | 72/336 |
| 1,159,322 | 11/1915 | Livingston | 72/324 |
| 1,771,955 | 7/1930 | Fork et al. | 72/168 X |
| 1,818,180 | 8/1931 | Weston et al. | 72/168 |
| 2,169,025 | 8/1939 | Forbes | 29/592 R |
| 3,139,034 | 6/1964 | Amirault et al. | 29/156.8 CF |
| 3,783,483 | 1/1974 | Ivey | 29/455 X |
| 3,793,865 | 2/1974 | Krabacher | 72/197 |
| 3,831,675 | 8/1974 | McLain | 228/173 D X |
| 3,861,140 | 1/1975 | Krabacher | 60/262 |
| 3,921,432 | 11/1975 | Rivers | 72/168 X |
| 3,921,883 | 11/1975 | McLain | 228/173 D X |
| 4,045,957 | 9/1977 | DiSabato | 60/262 |
| 4,077,206 | 3/1978 | Ayyagari | 60/262 |
| 4,149,375 | 4/1979 | Wynosky et al. | 60/262 |
| 4,184,238 | 1/1980 | Carey | 29/157 C |
| 4,395,815 | 8/1983 | Stanley et al. | 72/168 X |

FOREIGN PATENT DOCUMENTS

| | | | |
|---|---|---|---|
| 0041010 | 10/1965 | German Democratic Rep. | 72/176 |

*Primary Examiner*—Charlie T. Moon
*Assistant Examiner*—Ronald S. Wallace
*Attorney, Agent, or Firm*—Francis L. Conte; Derek P. Lawrence

[57] ABSTRACT

A method is provided of forming a circular chuted axially extending mixer from an originally circular scalloped, radially extending ring blank. The method utilizes a common mechanical press with male and female die portions. The female portion is pressed down over the blank against the male portion to form a convolution in the blank, with progressively increasing height. Successive convolutions are formed which tends to gather together the radially outer portion of the blank thereby straightening its originally circular shape. Repeating this process forms a relatively straight band having convolutions forming chutes therebetween. Individual chuted bands can be joined together to form a single circular chuted axially extending mixer.

6 Claims, 5 Drawing Figures

CHUTED MIXER FORMING METHOD

The U.S. Government has certain rights in respect to this invention pursuant to Contract No. N00019-76-C-0261 awarded by the U.S. Navy.

BACKGROUND OF THE INVENTION

1. Field of the Invention

This invention relates to methods of forming chuted mixers of the type commonly used in gas turbine aircraft engines.

2. Summary of the Prior Art

In the course of gas turbine engine development, various thermodynamic concepts have evolved which require the mixing of two separate gas flows in an efficient manner. Frequently this mixing is required because the two gas flows are at widely varying temperatures and/or pressures and they must be combined together to form a single homogeneous flow of gases.

Because the current gas turbine aircraft engine is usually a machine that is circular in cross section with various structures emanating radially about an engine centerline, many of these gas flows that must be mixed are circumferential or ring-like in cross section. Therefore, when these gas flows are mixed, the pattern of the mixing is often radial in direction across a circumferential or ring-like cross section.

Various structures have been developed to accomplish radial mixing of gas flows. One structure that is used to accomplish this purpose is commonly referred to as a chuted mixer. Examples of chuted mixers are disclosed in U.S. Pat. No. 4,265,646, Weinstein, et al, and U.S. Pat. No. 3,861,140, Krabacher. Essentially the chuted mixer structure is a ring provided with lobes or chutes extending in a single direction in respect to the ring. These chutes accomplish a function of directing a gas flow originating radially to one side of the mixer and directing that gas flow radially to the opposite side of the mixer. These chuted mixer structures are well known to those skilled in the art and have been used frequently in the aircraft engine industry.

While such chuted mixers are very useful as a gas flow mixing device, they are not particularly simple to manufacture. One previous construction method involves manufacture of several individual lobe structures that are welded together to form a single mixer structure. After individual lobes are connected to form a circular chuted mixer, the mixer has to be reworked in various ways in order to attain appropriate dimensions for assembly within an aircraft engine. Proper sizes and tolerances have been difficult to attain in the course of this reworking. Additionally, this method of construction has required considerable time and effort on the part of skilled machine operators.

Therefore, it is an object of the present invention to provide an improved method of construction of a chuted mixer that attains dimensional measurements and tolerances without requiring reworking and remachining to attain appropriate dimensions.

It is another object of the present invention to provide a method of manufacturing a chuted mixer that does not require joining of individual lobe structures to fabricate a complete daisy mixer.

It is another object of the present invention to provide a method of manufacturing a daisy mixer with cold metal pressing and forming techniques that do not require extreme stretching or reforming of a metal blank so as to avoid tearing or severing the blank.

SUMMARY OF THE INVENTION

These and other objects are accomplished in the present invention which is a method of forming a circular, chuted axially extending mixer. The method utilizes one or more flat circular, radially extending ring blanks, each blank having a scalloped outer edge. The blanks are usually cut radially before they are reshaped with cold metal forming techniques. The blank is reshaped by pressing portions of the blank at specific locations over a die that includes a curved bridge that progressively increases in height from a flat surface to a maximum height at its opposite end. The blanks are pressed over this die shape in a manner whereby the die ridge is aligned radially in relation to the blank and the pressing is done in radial alignment with dips along the scalloped outer edge of the blank. As the blank is pressed at each of these locations, the metal of the blank becomes reformed over the die to form a deep lobe or chute. As the material along the outer circumference of the blank is bent to form these lobes, the originally circular blank becomes straightened thereby forming a straight band with deep lobes projecting out of the band. After several blanks have been reformed in this fashion, one or more such reformed blanks can be joined together at their ends to form a single, circular, chuted axially extending mixer.

DESCRIPTION OF THE DRAWINGS

While the specification concludes with the claims, distinctly claiming and particularly pointing out the invention described herein, it is believed that the invention will be more clearly understood by reference to the discussion below in conjunction with the following drawings:

DESCRIPTION OF THE PREFERRED EMBODIMENT

Figure 1:
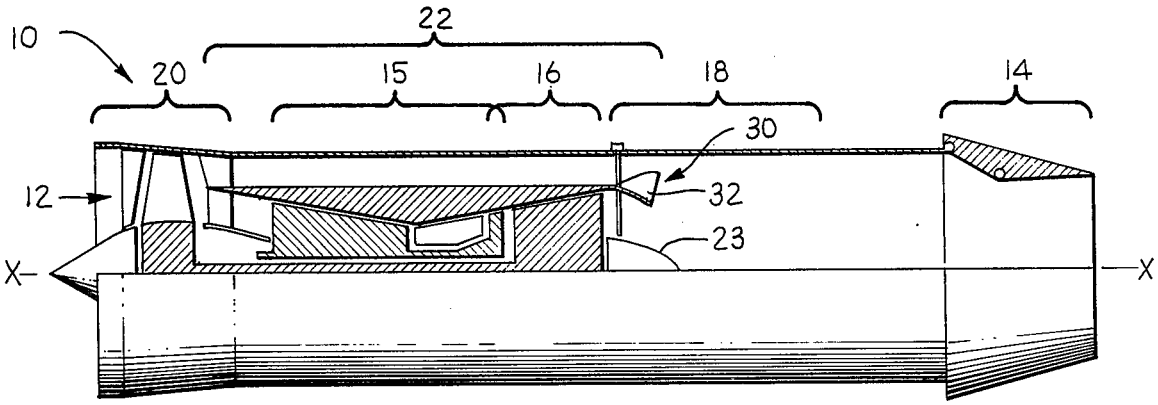
FIG. 1 is a schematic view, partly in cross-section and partly broken away of a gas turbine aircraft engine utilizing a chuted mixer.

Referring now to FIG. 1, there is shown schematically a gas turbine engine 10 of a type commonly used in jet fighter aircraft. As is typical of gas turbine aircraft engines, outside air is drawn into an inlet 12 of the engine for the purpose of compressing that air and mixing it with fuel within the engine to be burned to produce a high-energy hot gas stream. This high-energy hot gas stream is utilized within the engine 10 to power the engine. In the process of developing usable power, the engine actually produces two separate gas flows, both of which ultimately exit the engine through an exhaust nozzle 14 to produce forward thrust to power the aircraft.

The first of these two separate gas flows is the hot core engine flow stream itself, which flows through a turbine section 16 within the engine to power rotating turbines thereby producing mechanical power within the engine. The hot gases forming this core engine flow stream exit the turbine section 16 and flow downstream into an afterburner section 18.

At the same time as the hot core engine gases flow downstream through the engine part of the mechanical power that is developed in the turbine section 16 and is carried forward in the engine with a turbine shaft to a fan 20 located at the engine inlet 12. This fan 20 accelerates the inlet air in a downstream direction. While part of the air accelerated by the fan is directed into the core engine 15, the remainder of the inlet air is directed through a bypass section 22, so named because that section bypasses the core engine 15. The air in this section 22 is called bypass air and this air is directed downstream to the afterburner section 18.

It may now be surmised by the reader that both the hot core engine flow stream and the relatively cool bypass air are entering the afterburner section 18 simultaneously. In the bypass section 22, the bypass air is distributed radially outside the core engine in a circumferential flow pattern. Similarly, the core engine flow stream is distributed radially around a core engine bullet nose 23. These two circumferential flow streams must be mixed in a controlled and efficient manner as they enter the afterburner section in order that the flow stream can be properly combined with fuel and burned during afterburner operation. Afterburning forms a very high-speed exhaust flow that produces large amounts of thrust when necessary during jet fighter operation.

It has been found that mixing of these two flow streams can be accomplished by a chuted mixer 30 that is provided at a conjunction of the two flow streams. Such chuted mixers are well known to those skilled in the art. Essentially, the function of a chuted mixer is to direct an inner flow stream radially outwardly through chutes 32, while simultaneously directing an outer gas flow stream radially inwardly through troughs or convolutions between the chutes. This permits formerly outer and inner flow streams to mix in a side-by-side fashion which inherently permits mixing of flow streams over a larger surface area. This tends to provide more efficient and controlled mixing of the two flow streams.

After the flow streams have been mixed by the chuted mixer 30, the combined flow stream is mixed with fuel and ignited in the afterburner section 18 and directed through the exhaust nozzle 14 to provide forward thrust for the aircraft.

Figure 2:
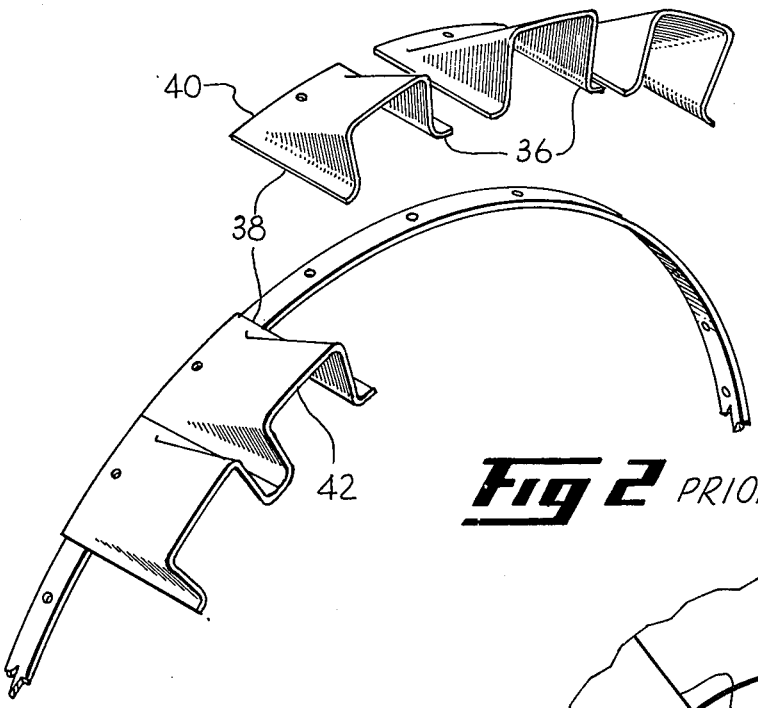
Fig 2 PRIOR ART
FIG. 2 is an elevation view of a plurality of chutes that are joined together to form a chuted mixer using prior art methods.

Referring now to FIG. 2, chuted mixers such as the one shown in FIG. 1 have been formed from sets of individual chutes 36. Individual chutes 36 can be manufactured with typical stamping and pressing techniques. However, formation of more than a single chute at one time has been found to cause excessive stress resulting in tearing of the material such as metal sheets used to make the chutes. After each individual chute was formed, the chutes would be trimmed and then welded together at side edges 38. A certain number of individual chutes 36 would be welded together to form a complete ring thereby creating a circular chuted axially extending mixer. This welded fabrication method often resulted in oversized or undersized rings. To change the diameter of the chuted mixer, the original welds would have to be severed and welded a second time. Additionally, the chuted mixer would usually have to be trimmed at its forward and aft edges 40 and 42 respectively to provide proper fitting within the aircraft engine.

Figure 3:
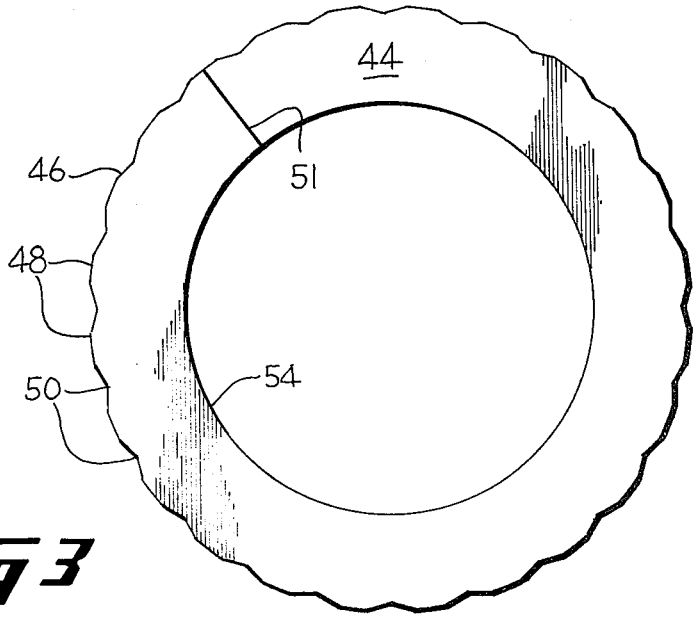
FIG. 3 shows an elevation view of a blank that can be utilized in manufacturing a chuted mixer with the method of the present invention.

Referring now to FIG. 3, a blank structure 44 that can be utilized in the method of the present invention is shown in a form ready to be cold-worked into a chuted mixer. Typically, this blank 44 can be stamped out of a flat metal sheet using common metal stamping techniques. The blank 44 is basically circular in shape but is scalloped at its outer edge 46. The scalloped outer edge 46 has both outward projections 48 and dips 50 that are specifically utilized later in the forming process of this invention.

The circular metal blank 44 is cut radially at one location 51. In one method of the present invention this radial cut is aligned with a center of an individual outward projection 48. It shall be appreciated by the reader that it is not necessary to cut the blank if a single blank is used to form an entire finished chuted mixer.

Figure 4:
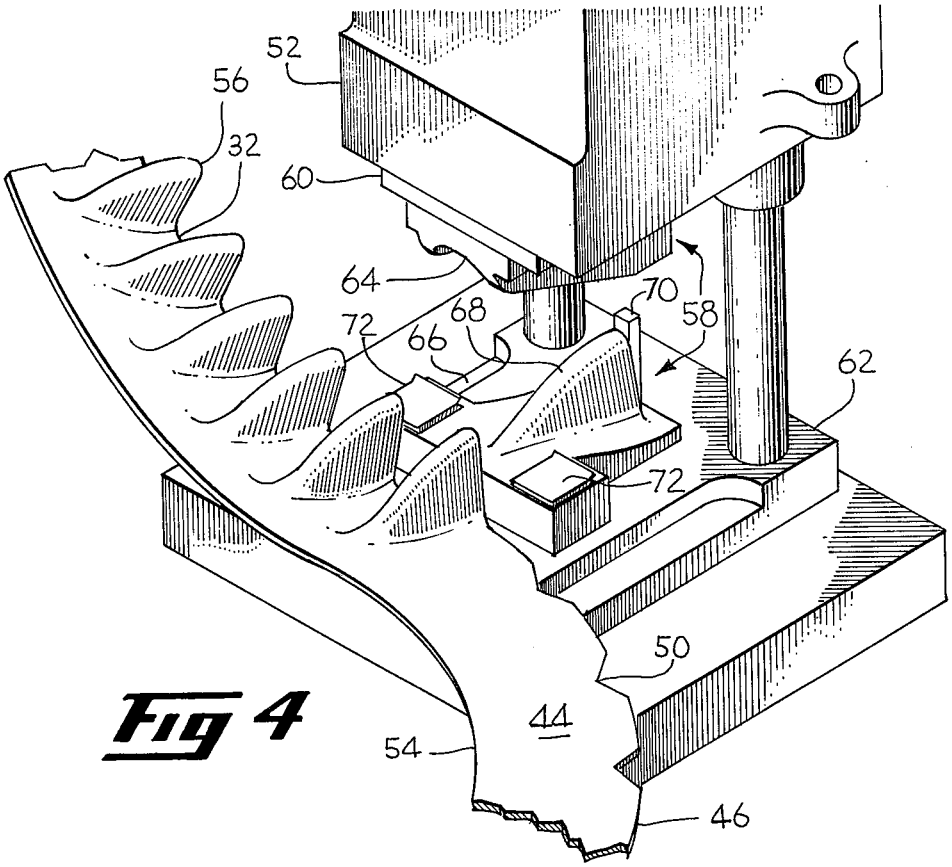
FIG. 4 shows a perspective view of a press, a die, and a blank as are utilized for manufacturing a chuted mixer in a method of the present invention.

Referring now to FIG. 4, the blank structure 44 is shown while it is being pressed by a mechanical press 52 in a method of the present invention for the purpose of forming individual chutes 32. A significant feature of this invention is that metal is not being significantly stretched in order to form the individual chutes 32. Rather, the metal of the blank structure 44 is bent in a die to shape the metal rather than stretch the metal. This can be accomplished because originally the blank 44 is a ring that inherently increases in circumference in a radially outer direction. Because it is a ring, there is greater surfce area per unit of radial length at the region of the outer edge 46 of the blank as opposed to the region of an inner edge 54. Because of this inherent feature of a ring-like blank structure, the metal can be pressed in the die to form convolutions 56 progressively increasing in height in the direction of the blank's outer edge 46 without stretching the material. The metal between these convolutions 56 forms the individual chutes 32 of the chuted mixer. In the process of forming these convolutions 56, the formerly circular shape of the blank 44 tends to be transformed into a straight band. The structure of the blank 44 has become essentially straight because the increasing surface area (per unit of radial length) towards the blank's outer edge 46 has been utilized to form the convolutions 56 that become walls of the individual chutes 32.

In the process of forming the individual convolutions 56, the blank 44 is inserted manually into a die 58. Die sets of the type shown in FIG. 4 are quite common and can be purchased in unfinished form from a variety of commercial sources. The die 58 has an upper and lower platform 60 and 62 respectively. These upper and lower platforms 60 and 62 hold female and male die portions 64 and 66 respectively. The male portion 66 of the die forms a bulge 68 that projects from a relatively flat surface of the male portion. The bulge 68 progressively increases in height from front to back and terminates at its forward boundary at a location that is set back from a forward edge of the male die portion 66. The female die portion 64 includes an inward projection that cooperates with the male die portion 66. In the operation of the mechanical press 52, the upper platform 60 is pressed down towards the lower platform 62. As the upper platform is lowered, the female die portion 64 is pressed down over the blank 44 such that the bulge 68 of the male die portion cooperates with the female die portion 66 to form a convolution 56 in the blank 44.

Each of these convolutions 56 are aligned radially with the dips 50 of the blank outer edge 46. This alignment is accomplished manually by the operator by inserting the blank 44 over the male die portion 66 such that the bulge 68 is aligned with the dip 50 of the blank before the pressing operation takes place. This alignment is promoted by locating a pin 70 on the bulge 68 of the male die portion such that when the blank 44 is placed on the male die portion 66 the pin 70 projects upwardly through a space provided by the dip 50 thereby locking the blank 44 in place during the pressing operation. In order to help prevent the blank 44 from sliding or slipping during the pressing operation, spring loaded tabs 72 are provided to press down over the blank 44 to keep it from slipping during the pressing operation. This permits the operator of the press to remove both hands from the blank 44 as is generally required by U.S. Government Occupational, Safety, and Health Administration regulations.

This pressing operation is repeated at each dip location 50 on the blank 44 thereby forming a series of chutes 32 projecting from a straight band 74.

Figure 5:
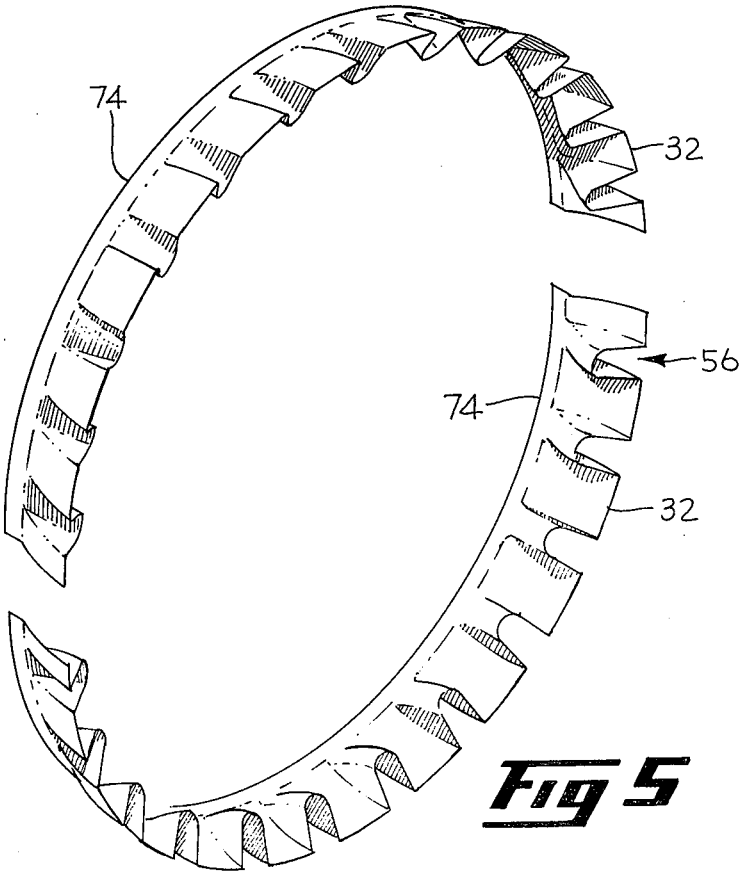
FIG. 5 shows a perspective view of reformed blanks that can be joined together in a method of manufacturing a chuted mixer of the present invention.

Referring now to FIG. 5, each of these bands 74 with projecting chutes 32 interspaced between convolutions 56 can now be joined together to form a circular chuted axially extending mixer. Any number of bands 74 can be utilized at this stage to form the circular mixer. If a single band 74 were utilized it would simply be bent into a single hoop and welded together into a circular shape. In FIG. 5, two bands 74 are shown bent into semicircles that are joined together at their ends with common welding techniques to form a single circular chuted mixer. Similarly, larger numbers of bands 74 could be utilized to form increasingly larger mixers depending upon the size mixer that is desired.

It will be understood that while the present invention has been described in terms of a preferred method, it will be apparent to those skilled in the art that changes and modifications thereof may be made without departing from the scope of the appended claims which define the present invention.

Having described the invention, what is claimed as novel and desired to be secured by Letters Patent of the United States is:

1. A method of forming a band for forming a chuted mixer comprising the steps of:

providing a flat outer edge and a radially inner edge, said outer edge including a plurality of circumferentially spaced, radially inwardly disposed dips;

cutting said blank radially from said inner edge to said outer edge;

providing a die having a bulge progressively increasing in height from a front end to a back end thereof;

pressing said blank over said bulge of said die to form a convolution in said blank in a manner wherein said die bulge is aligned radially in relation to said blank at one of said dips, said front end of said bulge being disposed adjacent to said radially inner edge of said blank and said back end of said bulge being disposed adjacent to said one of said dips; and repeating said step of pressing said blank over said bulge at each of said dips for thereby forming a straight band having convolutions defining chutes between adjacent ones of said convolutions.

2. The method recited in claim 1, including a step of forming said band into an arc so that said inner and outer edges are axially spaced from each other.

3. The method recited in claim 2, including a step of joining said band together at ends thereof to form a circular, axially extending chuted mixer.

4. A method of forming a circular chuted mixer comprising the steps of:

providing a flat radially extending ring blank having a scalloped radially outer edge and a radially inner edge, said outer edge including a plurality of circumferentially spaced, radially inwardly disposed dips;

cutting said blank radially from said inner edge to said outer edge;

forming radial convolutions in said blank at locations aligned with said dips of said scalloped outer edge, said convolutions progressively increasing in height in a radially outward direction, thereby forming a straight band with said convolutions defining chutes therebetween;

forming said band into an arc so that said inner and outer edges are axially spaced from each other; and joining said band together at ends formed by said radial cutting to form a circular, axially extending chuted mixer.

5. The method according to claim 4 wherein a plurality of said ring blanks are provided, formed with said convolutions and cut radially, and further including steps of aligning said plurality of blanks end to end and joining said ends to form said circular chuted mixer.

6. The method according to claim 3 wherein a plurality of said arcuate blanks are provided and formed with convolutions and into a plurality of straight bands, said bands being formed into arcs, and further including steps of aligning said bands end to end and joining said ends to form said chuted mixer.

* * * * *